US012742128B2

(12) United States Patent
Mezger et al.

(10) Patent No.: US 12,742,128 B2
(45) Date of Patent: Sep. 22, 2026

(54) MIXTURES FOR IMPROVING THE STABILITY OF ADDITIVE PACKAGES

(71) Applicant: BASF SE, Ludwigshafen am Rhein (DE)

(72) Inventors: Jochen Mezger, Ludwigshafen (DE); Harald Boehnke, Ludwigshafen (DE); Tarik Atilgan, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 18/257,851

(22) PCT Filed: Dec. 6, 2021

(86) PCT No.: PCT/EP2021/084384
§ 371 (c)(1),
(2) Date: Jun. 15, 2023

(87) PCT Pub. No.: WO2022/128569
PCT Pub. Date: Jun. 23, 2022

(65) Prior Publication Data

US 2024/0084208 A1 Mar. 14, 2024

(30) Foreign Application Priority Data

Dec. 16, 2020 (EP) ..... 20214623

(51) Int. Cl.
*C10L 1/198* (2006.01)
*C10L 1/14* (2006.01)
(Continued)

(52) U.S. Cl.
CPC ..... *C10L 1/1983* (2013.01); *C10L 1/143* (2013.01); *C10L 1/1966* (2013.01); *C10L 1/221* (2013.01);
(Continued)

(58) Field of Classification Search
CPC ..... C10L 1/143; C10L 1/1966; C10L 1/1983; C10L 1/221; C10L 1/224; C10L 1/2381; C10L 2270/023; C10L 2300/20
See application file for complete search history.

(56) References Cited

U.S. PATENT DOCUMENTS 8,287,608 B2 * 10/2012 Schwab ..... C10L 10/14 44/412
9,062,265 B2 * 6/2015 Reid ..... C10L 10/04
(Continued)

FOREIGN PATENT DOCUMENTS

WO WO-2015/113681 A1 8/2015
WO WO-2015/114029 A1 8/2015
WO WO-2022/106301 A1 5/2022

OTHER PUBLICATIONS

International Search Report for PCT Patent Application No. PCT/EP2021/084384, Issued on Mar. 17, 2022, 3 pages.
(Continued)

*Primary Examiner* — James C Goloboy
(74) *Attorney, Agent, or Firm* — Grüneberg Global IP, PLLC

(57) ABSTRACT

Mixtures of certain olefin-carboxylic acid copolymers (A) with at least one additive with detergent action, preferably at least one quaternary nitrogen compound (B), and optionally further fuel additives, are useful for improving the stability of additive packages for fuels, especially fuel oils and gasoline fuels.

16 Claims, 2 Drawing Sheets

Figure 1:
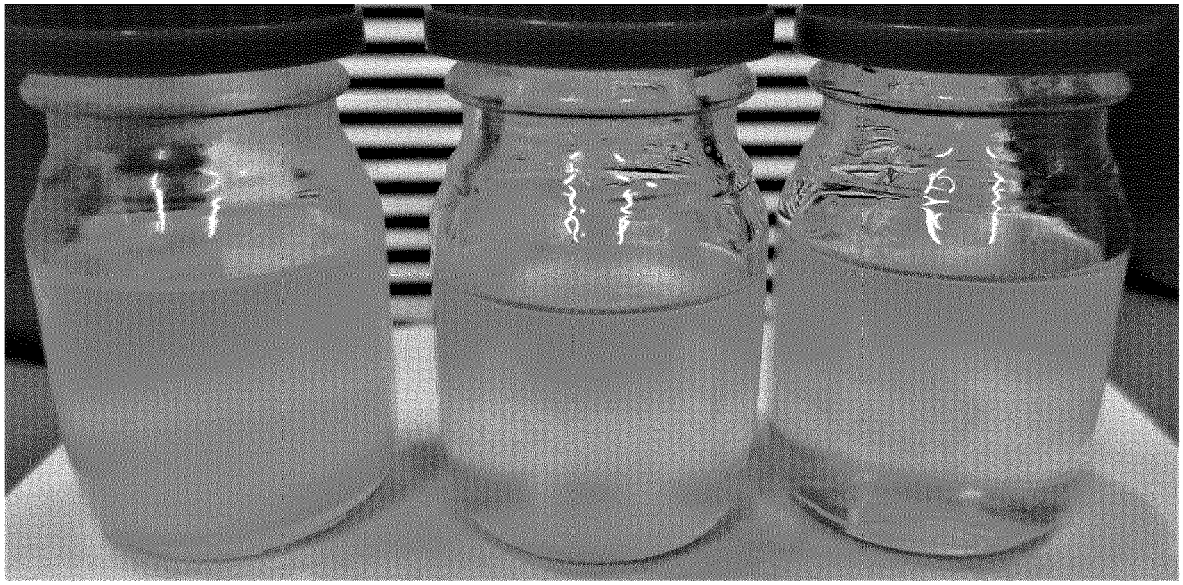

(51) Int. Cl.

| | |
|---|---|
| ***C10L 1/196*** | (2006.01) |
| ***C10L 1/22*** | (2006.01) |
| ***C10L 1/224*** | (2006.01) |
| ***C10L 1/238*** | (2006.01) |

(52) U.S. Cl.
CPC ..... *C10L 1/224* (2013.01); *C10L 1/2381* (2013.01); *C10L 2270/023* (2013.01); *C10L 2300/20* (2013.01)

(56) References Cited

U.S. PATENT DOCUMENTS

| | | | | |
|---|---|---|---|---|
| 10,377,958 | B2 | 8/2019 | Mezger et al. | |
| 10,407,634 | B2 * | 9/2019 | Hansch | C10M 141/06 |
| 11,634,654 | B2 | 4/2023 | Peretolchin et al. | |
| 2008/0307698 | A1 * | 12/2008 | Barton | C10L 1/2387 44/435 |
| 2016/0160142 | A1 * | 6/2016 | Reid | C10L 1/143 548/542 |
| 2017/0183590 | A1 * | 6/2017 | Mezger | C08F 222/06 |
| 2019/0249099 | A1 | 8/2019 | Peretolchin et al. | |

OTHER PUBLICATIONS

International Preliminary Report on Patentability for PCT Patent Application No. PCT/EP2021/084384, Issued on Jun. 29, 2023, 7 pages.
Written Opinion for PCT Patent Application No. PCT/EP2021/084384, Issued on Mar. 17, 2022, 5 pages.

* cited by examiner

MIXTURES FOR IMPROVING THE STABILITY OF ADDITIVE PACKAGES

CROSS-REFERENCE TO RELATED APPLICATIONS

This application is the National Stage entry under § 371 of International Application No. PCT/EP2021/084384, filed on Dec. 6, 2021, and which claims the benefit of priority to European Application No. 20214623.9, filed on Dec. 16, 2020. The content of each of these applications is hereby incorporated by reference in its entirety.

The present invention relates to the use of mixtures of certain olefin-carboxylic acid copolymers (A) with at least one additive with detergent action, preferably at least one quaternary nitrogen compound (B) and optionally further fuel additives for improving the stability of additive packages for fuels, especially fuel oils and gasoline fuels.

Fuel additive mixtures (also referred to as fuel additive packages or additive packages), especially when they contain components of different density, polarity, solubility, and/or crystallisation temperatures, during storing, may form sediments or separate phases or demixing especially on cooling. Especially in the case of highly polar quaternary ammonium compounds as modern constituents of additive packages there is a need for a stabilization of fuel additives. Such stabilization is achieved by compatibilizers or stabilizers.

WO 15/113681 discloses the use of olefin-carboxylic acid copolymers, wherein the copolymer comprises at least one free carboxylic acid side group, as a fuel additive or lubricant additive or as corrosion inhibitor, see e.g. WO 15/114029, therefore, the presence of such copolymers in fuels is desirable in order to prevent formation of or remove existing deposits in engines or rely on the corrosion inhibiting effect.

Unpublished European Patent Application No. 20208827.4 filed on Nov. 20, 2020, respectively unpublished PCT Application No. PCT/EP2021/081447 filed on Nov. 12, 2021, discloses the use of mixtures of components (A) and (B) for improving or boosting the separation of water from fuels.

No stabilizing activity of such copolymers is reported in WO 15/113681 or rendered obvious.

Therefore, it was an object of the present invention to provide an additive package with an improved demixing stability, especially when quaternary ammonium compounds are part of the package.

"Stabilization" as used in the present document means a lesser tendency of additive packages or components thereof to demix, especially at low temperatures and encompasses storage stability, preferably over several days, e.g. at least three days, more preferably several weeks, e.g. at least four weeks, even more preferably several months, e.g. at least two months. The phrase "compatibilization" is used synonymously. Signs of demixing may be e.g. formation of separate liquid or solid phases, formation of precipitates, and turbidity.

"Stabilization" as used in the present document does not mean stabilization against decomposition of additive packages or components, e.g. due to oxidation or thermal strain.

Accordingly, the above defined use of mixtures of certain olefin-carboxylic acid copolymers (A) with at least one additive with detergent action selected from the group consisting of quaternary nitrogen compounds (B) and polyisobutenylsuccinimides (G) for improving the stability of fuel additive packages or their constituents has been found.

In an adequate amount component (A) is able to stabilize fuel additive packages or their constituents, especially component (B) at low temperatures, e.g. down to 0° C., preferably down to −10° C., more preferably down to −20° C., and even at lower temperatures over an extended period of time.

Compound (A)

The olefin-carboxylic acid copolymer (A) is a copolymer obtainable by in a first reaction step (I) copolymerizing (Aa) at least one ethylenically unsaturated mono- or dicarboxylic acid or derivatives thereof, preferably a dicarboxylic acid, (Ab) at least one α-olefin having from at least 12 up to and including 30 carbon atoms, (Ac) optionally at least one further aliphatic or cycloaliphatic olefin which has at least 4 carbon atoms and is different than (Ab) and (Ad) optionally one or more further copolymerizable monomers other than monomers (Aa), (Ab) and (Ac), selected from the group consisting of (Ada) vinyl esters, (Adb) vinyl ethers, (Adc) (meth)acrylic esters of alcohols having at least 5 carbon atoms, (Add) allyl alcohols or ethers thereof, (Ade)N-vinyl compounds selected from the group consisting of vinyl compounds of heterocycles containing at least one nitrogen atom, N-vinylamides or N-vinyllactams, (Adf) ethylenically unsaturated aromatics, (Adg) α,β-ethylenically unsaturated nitriles, (Adh) (meth)acrylamides and (Adi) allylamines, followed by in a second optional reaction step (II) partly or fully hydrolyzing and/or saponifying anhydride or carboxylic ester functionalities present in the copolymer obtained from (I), the second reaction step being run at least when the copolymer obtained from reaction step (I) does not comprise any free carboxylic functionalities.

Description of the Copolymer (A)

The monomer (Aa) is at least one, preferably one to three, more preferably one or two and most preferably exactly one ethylenically unsaturated, preferably α,β-ethylenically unsaturated, mono- or dicarboxylic acid(s) or derivatives thereof, preferably a dicarboxylic acid or derivatives thereof.

Derivatives are understood to mean the corresponding anhydrides in monomeric or else polymeric form, mono- or dialkyl esters, preferably mono- or di-$C_1$-$C_4$-alkyl esters, more preferably mono- or dimethyl esters or the corresponding mono- or diethyl esters, and mixed esters, preferably mixed esters having different $C_1$-$C_4$ alkyl components, more preferably mixed methyl ethyl esters.

Preferably, the derivatives are anhydrides in monomeric form or di-$C_1$-$C_4$-alkyl esters, more preferably anhydrides in monomeric form.

In the context of this document, $C_1$-$C_4$-alkyl is understood to mean methyl, ethyl, iso-propyl, n-propyl, n-butyl, iso-butyl, sec-butyl and tert-butyl, preferably methyl and ethyl, more preferably methyl.

Examples of α,β-ethylenically unsaturated mono- or dicarboxylic acids are those mono- or dicarboxylic acids or derivatives thereof in which the carboxyl group or, in the case of dicarboxylic acids, at least one carboxyl group, preferably both carboxyl groups, is/are conjugated to the ethylenically unsaturated double bond.

Examples of ethylenically unsaturated mono- or dicarboxylic acids that are not α,β-ethylenically unsaturated are cis-5-norbornene-endo-2,3-dicarboxylic anhydride, exo-3,6-epoxy-1,2,3,6-tetrahydrophthalic anhydride and cis-4-cyclohexene-1,2-dicarboxylic anhydride.

Examples of α,β-ethylenically unsaturated monocarboxylic acids are acrylic acid, methacrylic acid, crotonic acid and ethylacrylic acid, preferably acrylic acid and methacrylic acid, referred to in this document as (meth)acrylic acid for short, and more preferably acrylic acid.

Particularly preferred derivatives of α,β-ethylenically unsaturated monocarboxylic acids are methyl acrylate, ethyl acrylate, n-butyl acrylate and methyl methacrylate.

Examples of dicarboxylic acids are maleic acid, fumaric acid, itaconic acid (2-methylenebutane-dioic acid), citraconic acid (2-methylmaleic acid), glutaconic acid (pent-2-ene-1,5-dicarboxylic acid), 2,3-dimethylmaleic acid, 2-methylfumaric acid, 2,3-dimethylfumaric acid, methylenemalonic acid and tetrahydrophthalic acid, preferably maleic acid and fumaric acid and more preferably maleic acid and derivatives thereof.

More particularly, monomer (Aa) is maleic anhydride.

Monomer (Ab) is at least one, preferably one to four, more preferably one to three, even more preferably one or two and most preferably exactly one α-olefin(s) having from at least 12 up to and including 30 carbon atoms. The α-olefins (Ab) preferably have at least 14, more preferably at least 16 and most preferably at least 18 carbon atoms. Preferably, the α-olefins (Ab) have up to and including 28, more preferably up to and including 26 and most preferably up to and including 24 carbon atoms.

Preferably, the α-olefins may be one or more linear or branched, preferably linear, 1-alkene.

Examples of these are 1-dodecene, 1-tridecene, 1-tetradecene, 1-pentadecene, 1-hexadecene, 1-heptadecene, 1-octadecene, 1-nonodecene, 1-eicosene, 1-docosene, 1-tetracosene, 1-hexacosene, preference being given to 1-octadecene, 1-eicosene, 1-docosene and 1-tetracosene, and mixtures thereof.

Further examples of α-olefin (Ab) are those olefins which are oligomers or polymers of $C_2$ to $C_{12}$ olefins, preferably of $C_3$ to $C_{10}$ olefins, more preferably of $C_4$ to $C_6$ olefins. Examples thereof are ethene, propene, 1-butene, 2-butene, isobutene, pentene isomers and hexene isomers, preference being given to ethene, propene, 1-butene, 2-butene and isobutene.

Named examples of α-olefins (Ab) include oligomers and polymers of propene, 1-butene, 2-butene, isobutene, and mixtures thereof, particularly oligomers and polymers of propene or isobutene or of mixtures of 1-butene and 2-butene. Among the oligomers, preference is given to the trimers, tetramers, pentamers and hexamers, and mixtures thereof.

In addition to the olefin (Ab), it is optionally possible to incorporate at least one, preferably one to four, more preferably one to three, even more preferably one or two and especially exactly one further aliphatic or cycloaliphatic olefin(s) (Ac) which has/have at least 4 carbon atoms and is/are different than (Ab) by polymerization into the inventive copolymer.

The olefins (Ac) may be olefins having a terminal (α-) double bond or those having a non-terminal double bond, preferably having an α-double bond. The olefin (Ac) preferably comprises olefins having 4 to fewer than 12 or more than 30 carbon atoms. If the olefin (Ac) is an olefin having 12 to 30 carbon atoms, this olefin (Ac) does not have an α-double bond.

Examples of aliphatic olefins (Ac) are 1-butene, 2-butene, isobutene, pentene isomers, hexene isomers, heptene isomers, octene isomers, nonene isomers, decene isomers, undecene isomers and mixtures thereof.

Examples of cycloaliphatic olefins (Ac) are cyclopentene, cyclohexene, cyclooctene, cyclodecene, cyclododecene, α- or β-pinene and mixtures thereof, limonene and norbornene.

Further examples of olefins (Ac) are polymers having more than 30 carbon atoms of propene, 1-butene, 2-butene or isobutene or of olefin mixtures comprising the latter, preferably of isobutene or of olefin mixtures comprising the latter, more preferably having a mean molecular weight $M_w$ in the range from 500 to 5000 g/mol, preferably 650 to 3000 and more preferably 800 to 1500 g/mol.

Preferably, the oligomers or polymers comprising isobutene in copolymerized form have a high content of terminal ethylenic double bonds (α-double bonds), for example at least 50 mol %, preferably at least 60 mol %, more preferably at least 70 mol % and most preferably at least 80 mol %.

For the preparation of such oligomers or polymers comprising isobutene in copolymerized form, suitable isobutene sources are either pure isobutene or isobutene-containing C4 hydrocarbon streams, for example C4 raffinates, especially "raffinate 1", C4 cuts from isobutane dehydrogenation, C4 cuts from steamcrackers and from FCC crackers (fluid catalyzed cracking), provided that they have substantially been freed of 1,3-butadiene present therein. A C4 hydrocarbon stream from an FCC refinery unit is also known as a "b/b" stream. Further suitable isobutene-containing C4 hydrocarbon streams are, for example, the product stream of a propylene-isobutane cooxidation or the product stream from a metathesis unit, which are generally used after customary purification and/or concentration. Suitable C4 hydrocarbon streams comprise generally less than 500 ppm, preferably less than 200 ppm, of butadiene. The presence of 1-butene and of cis- and trans-2-butene is substantially uncritical. Typically, the isobutene concentration in said C4 hydrocarbon streams is in the range from 40% to 60% by weight. For instance, raffinate 1 generally consists essentially of 30% to 50% by weight of isobutene, 10% to 50% by weight of 1-butene, 10% to 40% by weight of cis- and trans-2-butene and 2% to 35% by weight of butanes; in the polymerization process the unbranched butenes in the raffinate 1 are generally virtually inert, and only the isobutene is polymerized.

In a preferred embodiment, the monomer source used for polymerization is a technical C4 hydrocarbon stream having an isobutene content of 1% to 100% by weight, especially of 1% to 99% by weight, in particular of 1% to 90% by weight, more preferably of 30% to 60% by weight, especially a raffinate 1 stream, a b/b stream from an FCC refinery unit, a product stream from a propylene-isobutane cooxidation or a product stream from a metathesis unit.

Especially when a raffinate 1 stream is used as isobutene source, the use of water as the sole initiator or as further initiator has been found to be useful, particularly when polymerization is effected at temperatures of −20° C. to +30° C., especially of 0° C. to +20° C. At temperatures of −20° C. to +30° C., especially of 0° C. to +20° C., however, it is possible to dispense with the use of an initiator when using a raffinate 1 stream as isobutene source.

Said isobutene-containing monomer mixture may comprise small amounts of contaminants such as water, carboxylic acids or mineral acids without causing any critical yield or selectivity losses. It is appropriate to the purpose to avoid accumulation of these impurities by removing such harmful substances from the isobutene-containing monomer mixture, for example, by adsorption on solid adsorbents such as activated carbon, molecular sieves or ion exchangers.

It is also possible, albeit less preferable, to convert monomer mixtures of isobutene or of the isobutene-containing hydrocarbon mixture with olefinically unsaturated monomers copolymerizable with isobutene. If monomer mixtures of isobutene with suitable comonomers are to be copolymerized, the monomer mixture comprises preferably at least 5% by weight, more preferably at least 10% by weight and especially at least 20% by weight of isobutene, and preferably at most 95% by weight, more preferably at most 90% by weight and especially at most 80% by weight of comonomers.

In a preferred embodiment, the mixture of the olefins (Ab) and optionally (Ac), averaged to their molar amounts, have at least 12 carbon atoms, preferably at least 14, more preferably at least 16 and most preferably at least 17 carbon atoms.

For example, a 2:3 mixture of docosene and tetradecene has an averaged value for the carbon atoms of $0.4\times22+0.6\times14=17.2$.

The upper limit is less relevant and is generally not more than 60 carbon atoms, preferably not more than 55, more preferably not more than 50, even more preferably not more than 45 and especially not more than 40 carbon atoms.

The optional monomer (Ad) is at least one monomer, preferably one to three, more preferably one or two and most preferably exactly one monomer(s) selected from the group consisting of (Ada) vinyl esters,
(Adb) vinyl ethers,
(Adc) (meth)acrylic esters of alcohols having at least 5 carbon atoms,
(Add) allyl alcohols or ethers thereof,
(Ade)N-vinyl compounds selected from the group consisting of vinyl compounds of heterocycles containing at least one nitrogen atom, N-vinylamides or N-vinyllactams,
(Adf) ethylenically unsaturated aromatics and
(Adg) α,β-ethylenically unsaturated nitriles,
(Adh) (meth)acrylamides and
(Adi) allylamines.

Examples of vinyl esters (Ada) are vinyl esters of $C_2$- to $C_{12}$-carboxylic acids, preferably vinyl acetate, vinyl propionate, vinyl butyrate, vinyl pentanoate, vinyl hexanoate, vinyl octanoate, vinyl 2-ethylhexanoate, vinyl decanoate, and vinyl esters of Versatic Acids 5 to 10, preferably vinyl esters of 2,2-dimethylpropionic acid (pivalic acid, Versatic Acid 5), 2,2-dimethylbutyric acid (neo-hexanoic acid, Versatic Acid 6), 2,2-dimethylpentanoic acid (neoheptanoic acid, Versatic Acid 7), 2,2-dimethylhexanoic acid (neooctanoic acid, Versatic Acid 8), 2,2-dimethylheptanoic acid (neononanoic acid, Versatic Acid 9) or 2,2-dimethyloctanoic acid (neodecanoic acid, Versatic Acid 10).

Examples of vinyl ethers (Adb) are vinyl ethers of $C_1$- to $C_{12}$-alkanols, preferably vinyl ethers of methanol, ethanol, iso-propanol, n-propanol, n-butanol, iso-butanol, sec-butanol, tert-butanol, n-hexanol, n-heptanol, n-octanol, n-decanol, n-dodecanol (lauryl alcohol) or 2-ethylhexanol.

Preferred (meth)acrylic esters (Adc) are (meth)acrylic esters of $C_5$- to $C_{12}$-alkanols, preferably of n-pentanol, n-hexanol, n-heptanol, n-octanol, n-decanol, n-dodecanol (lauryl alcohol), 2-ethylhexanol or 2-propylheptanol. Particular preference is given to pentyl acrylate, 2-ethylhexyl acrylate, 2-propylheptyl acrylate.

Examples of monomers (Add) are allyl alcohols and allyl ethers of $C_2$- to $C_{12}$-alkanols, preferably allyl ethers of methanol, ethanol, iso-propanol, n-propanol, n-butanol, iso-butanol, sec-butanol, tert-butanol, n-hexanol, n-heptanol, n-octanol, n-decanol, n-dodecanol (lauryl alcohol) or 2-ethylhexanol.

Examples of vinyl compounds (Ade) of heterocycles comprising at least one nitrogen atom are N-vinylpyridine, N-vinylimidazole and N-vinylmorpholine.

Preferred compounds (Ade) are N-vinylamides or N-vinyllactams.

Examples of N-vinylamides or N-vinyllactams (Ade) are N-vinylformamide, N-vinylacetamide, N-vinylpyrrolidone and N-vinylcaprolactam.

Examples of ethylenically unsaturated aromatics (Adf) are styrene and α-methylstyrene.

Examples of α,β-ethylenically unsaturated nitriles (Adg) are acrylonitrile and methacrylonitrile.

Examples of (meth)acrylamides (Adh) are acrylamide and methacrylamide.

Examples of allylamines (Adi) are allylamine, dialkylallylamine and trialkylallylammonium halides.

Preferred monomers (Ad) are (Ada), (Adb), (Adc), (Ade) and/or (Adf), more preferably (Ada), (Adb) and/or (Adc), even more preferably (Ada) and/or (Adc) and especially (Adc).

The incorporation ratio of the monomers (Aa) and (Ab) and optionally (Ac) and optionally (Ad) in the polymer obtained from reaction step (I) is generally as follows:

The molar ratio of (Aa)/((Ab) and (Ac)) (in total) is generally from 10:1 to 1:10, preferably 8:1 to 1:8, more preferably 5:1 to 1:5, even more preferably 3:1 to 1:3, particularly 2:1 to 1:2 and especially 1.5:1 to 1:1.5. In the preferred particular case of maleic anhydride as monomer (Aa), the molar incorporation ratio of maleic anhydride to monomers ((Ab) and (Ac)) (in total) is about 1:1.

The molar ratio of obligatory monomer (Ab) to monomer (Ac), if present, is generally of 1:0.05 to 10, preferably of 1:0.1 to 6, more preferably of 1:0.2 to 4, even more preferably of 1:0.3 to 2.5 and especially 1:0.5 to 1.5.

In a preferred embodiment, no optional monomer (Ac) is present in addition to monomer (Ab).

The proportion of one or more of the monomers (Ad), if present, based on the amount of the monomers (Aa), (Ab) and optionally (Ac) (in total) is generally 5 to 200 mol %, preferably 10 to 150 mol %, more preferably 15 to 100 mol %, even more preferably 20 to 50 mol % and especially 0 to 25 mol %.

In a preferred embodiment, no optional monomer (Ad) is present.

In a second reaction step (II), the anhydride or carboxylic ester functionalities present in the copolymer obtained from (I) are partly or fully hydrolyzed and/or saponified.

Reaction step (II) is obligatory in case the copolymer obtained from reaction step (I) does not comprise free carboxylic acid groups.

Hydrolization of anhydride groups is preferred over saponification of ester groups.

Preferably, 10% to 100% of the anhydride or carboxylic ester functionalities present are hydrolyzed and/or saponified, preferably at least 20%, more preferably at least 30%, even more preferably at least 50% and particularly at least 75% and especially at least 85%.

For a hydrolysis, based on the anhydride functionalities present, the amount of water that corresponds to the desired hydrolysis level is added and the copolymer obtained from (I) is heated in the presence of the added water. In general, a temperature of preferably 20 to 150° C. is sufficient for the purpose, preferably 60 to 100° C. If required, the reaction can be conducted under pressure in order to prevent the escape of water. Under these reaction conditions, in general, the anhydride functionalities in the copolymer are converted selectively, whereas any carboxylic ester functionalities present in the copolymer react at least only to a minor degree, if at all.

For a saponification, the copolymer is reacted with an amount of a strong base corresponding to the desired saponification level in the presence of water.

Strong bases used may preferably be hydroxides, oxides, carbonates or hydrogencarbonates of alkali metals or alkaline earth metals.

The copolymer obtained from (I) is then heated in the presence of the added water and the strong base. In general, a temperature of preferably 20 to 130° C. is sufficient for the purpose, preferably 50 to 110° C. If required, the reaction can be conducted under pressure.

It is also possible to hydrolyze the carboxylic ester functionalities with water in the presence of an acid. Acids used are preferably mineral acids, carboxylic acids, sulfonic acids or phosphorus acids having a pKa of not more than 5, more preferably not more than 4.

Examples are acetic acid, formic acid, oxalic acid, salicylic acid, substituted succinic acids, aromatically substituted or unsubstituted benzenesulfonic acids, sulfuric acid, nitric acid, hydrochloric acid or phosphoric acid; the use of acidic ion exchange resins is also conceivable.

In a preferred embodiment for anhydrides, especially maleic anhydride being monomers (Aa), such anhydride moieties are partly or fully, especially fully hydrolysed while potentially existing ester groups in the copolymer remain intact. In this case no saponification in step (II) takes place.

The copolymer obtained from (I) is then heated in the presence of the added water and the acid. In general, a temperature of preferably 40 to 200° C. is sufficient for the purpose, preferably 80 to 150° C. If required, the reaction can be conducted under pressure.

Should the copolymers obtained from step (II) still comprise residues of acid anions, it may be preferable to remove these acid anions from the copolymer with the aid of an ion exchanger and preferably exchange them for hydroxide ions or carboxylate ions, more preferably hydroxide ions. This is the case especially when the acid anions present in the copolymer are halides or contain sulfur or nitrogen.

The copolymer obtained from reaction step (II) generally has a weight-average molecular weight Mw of 0.5 to 20 kDa, preferably 0.6 to 15, more preferably 0.7 to 7, even more preferably 1 to 7 and especially 1.5 to 4 kDa (determined by gel permeation chromatography with tetrahydrofuran and polystyrene as standard).

The number-average molecular weight Mn is usually from 0.5 to 10 kDa, preferably 0.6 to 5, more preferably 0.7 to 4, even more preferably 0.8 to 3 and especially 1 to 2 kDa (determined by gel permeation chromatography with tetrahydrofuran and polystyrene as standard).

The polydispersity is generally from 1 to 10, preferably from 1.1 to 8, more preferably from 1.2 to 7, even more preferably from 1.3 to 5 and especially from 1.5 to 3.

The content of acid groups in the copolymer is preferably from 1 to 8 mmol/g of copolymer, more preferably from 2 to 7.5, even more preferably from 3 to 7 mmol/g of copolymer.

In a preferred embodiment, the copolymers comprise a high proportion of adjacent carboxylic acid groups, which is determined by a measurement of adjacency. For this purpose, a sample of the copolymer is heat-treated between two Teflon films at a temperature of 290° C. for a period of 30 minutes and an FTIR spectrum is recorded at a bubble-free site. The IR spectrum of Teflon is subtracted from the spectra obtained, the layer thickness is determined and the content of cyclic anhydride is determined.

In a preferred embodiment, the adjacency is at least 10%, preferably at least 15%, more preferably at least 20%, even more preferably at least 25% and especially at least 30%.

The olefin-carboxylic acid copolymer (A) is applied in the form of the free acid, i.e. COOH groups are present, or in the form of the anhydride which may be an intramolecular anhydride or an intermolecular anhydride linking two dicarboxylic acid molecules together, preferably in the form of a free acid. To a minor extent, some of the carboxylic functions may be present in salt form, e.g. as alkali or alkaline metal salts salts or as ammonium or substituted ammonium salts, depending on the pH value of the liquid phase. Preferably at least 50% of all carboxylic acid groups are available in the form of the free acid as COOH-groups, more preferably at least 66%, very preferably at least 75%, even more preferably at least 85%, and especially at least 95%. A single olefin-carboxylic acid copolymer (A) or a mixture of different olefin-carboxylic acid copolymers (A) may be used.

According to the present invention, the mixtures of olefin-carboxylic acid copolymer (A) with at least one additive with detergent action selected from the group consisting of quaternary nitrogen compounds (B) and polyisobutenylsuccinimides (G), preferably at least one quaternary nitrogen compound (B) exhibit an improved storage stability of the thus additized additive package compared with the same composition with the absence of component (A).

Often, storage stability is checked at different temperatures (e.g. at −20° C. or −10° C., room temperature, 40° C.) over several weeks, e.g. 6 or 8 weeks or even longer. Sometimes, storage stability is checked at an additive sample stored at varying temperatures (i.e. 1 week at −20° C., then 1 week at 0° C., and so forth). In the context of the present invention a fuel additive package is deemed to be stable if it can be stored over at least 8 weeks at room temperature and/or over at least 8 weeks at −20° C. without demixing of the components after warming to room temperature. Of course, the fuel additive packages may also stable under other storage conditions, e.g. at +40° C., not explicitly mentioned herein.

The at least one quaternary nitrogen component (B) refer, in the context of the present invention, to nitrogen compounds quaternized in the presence of an acid or in an acid-free manner, preferably obtainable by addition of a compound comprising at least one oxygen- or nitrogen-containing group reactive with an anhydride and additionally at least one quaternizable amino group onto a polycarboxylic anhydride compound and subsequent quaternization.

In most cases the quaternary nitrogen component (B) is an ammonium compound, however in the context of the present document morpholinium, piperidinium, piperazinium, pyrrolidinium, imidazolinium or pyridinium cations are also encompassed by the phrase "quaternary nitrogen component".

The quaternary ammonium compounds (B) are preferably of the formula $^{+}NR^1R^2R^3R^4A^-$ in which $A^-$ stands for an anion, preferably a carboxylate $R^5COO^-$ or a carbonate $R^5O—COO^-$, and $R^1$, $R^2$, $R^3$, $R^4$, and $R^5$ independently of another are an organic residue with from 1 to 100 carbon atoms, substituted or unsubstituted, preferably unsubstituted, linear or branched alkyl, alkenyl or hydroxyalkyl residue with 1 to 100, more preferably 1 to 75, even more preferably 1 to 30, most preferably 1 to 25 and especially 1 to 20 carbon atoms, $R^5$ additionally may be substituted or unsubstituted cycloalkyl or aryl residues bearing 5 to 20, preferably 5 to 12 carbon atoms.

It is also possible that the anion may be multiply charged negatively, e.g. if anions of dibasic acids are used, in this case the stoichiometric ratio of the ammonium ions to the anions corresponds to the ratio of positive and negative charges.

The same is true for salts in which the cation bears more than one ammonium ion, e.g. of the substituents connect two or more ammonium ions.

In the organic residues the carbon atoms may be interrupted by one or more oxygen and/or sulphur atoms and/or one or more substituted or unsubstituted imino groups, and may be substituted by $C_6$-$C_{12}$-aryl, $C_5$-$C_{12}$-cycloalkyl or a five- or six-membered, oxygen-, nitrogen- and/or sulphur-containing heterocycle or two of them together form an unsaturated, saturated or aromatic ring which may be interrupted by one or more oxygen and/or sulphur atoms and/or one or more substituted or unsubstituted imino groups, where the radicals mentioned may each be substituted by functional groups, aryl, alkyl, aryloxy, alkyloxy, halogen, heteroatoms and/or heterocycles.

Two of the residues $R^1$ to $R^4$ may together form an unsaturated, saturated or aromatic ring, preferably a five-, six- or seven-membered ring (including the nitrogen atom of the ammonium ion).

In this case the ammonium cation may be a morpholinium, piperidinium, piperazinium, pyrrolidinium, imidazolinium or pyridinium cation.

In these definitions $C_1$-$C_{20}$-alkyl which may be substituted by functional groups, aryl, alkyl, aryloxy, alkyloxy, halogen, heteroatoms and/or heterocycles is, for example, methyl, ethyl, propyl, isopropyl, n-butyl, sec-butyl, tert-butyl, pentyl, hexyl, heptyl, octyl, 2-ethylhexyl, 2,4,4-trimethylpentyl, decyl, dodecyl, tetradecyl, heptadecyl, octadecyl, eicosyl, 1,1-dimethylpropyl, 1,1-dimethylbutyl, 1,1,3,3-tetramethylbutyl, benzyl, 1-phenylethyl, 2-phenylethyl, α,α-dimethylbenzyl, benzhydryl, p-tol-ylmethyl,1-(p-butylphenypethyl, p-chlorobenzyl, 2,4-dichlorobenzyl, p-methoxybenzyl, m-ethoxybenzyl, 2-cyanoethyl, 2-cyanopropyl, 2-methoxycarbonylethyl, 2-ethoxycarbonylethyl, 2-butoxycarbonyl propyl, 1,2-di-(methoxycarbonyl)ethyl, 2-methoxyethyl, 2-ethoxyethyl, 2-butoxy-ethyl, diethoxymethyl, diethoxyethyl, 1,3-dioxolan-2-yl, 1,3-dioxan-2-yl, 2-methyl-1,3-dioxolan-2-yl, 4-methyl-1,3-dioxolan-2-yl, 2-isopropoxyethyl, 2-butoxypropyl, 2-octyloxyethyl, chloromethyl, 2-chloroethyl, trichloromethyl, trifluoromethyl, 1,1-dimethyl-2-chloroethyl, 2-methoxyisopropyl, 2-ethoxyethyl, butylthiomethyl, 2-dodecylthioethyl, 2-phenylthioethyl, 2,2,2-trifluoroethyl, 2-hydroxyethyl, 2-hydroxypropyl, 3-hydroxypropyl, 4-hydroxybutyl, 6-hydroxyhexyl, 2-aminoethyl, 2-aminopropyl, 3-aminopropyl, 4-aminobutyl, 6-aminohexyl, 2-methylaminoethyl, 2-methylaminopropyl, 3-methylaminopropyl, 4-methylaminobutyl, 6-methylaminohexyl, 2-dimethylaminoethyl, 2-dimethylaminopropyl, 3-dimethylaminopropyl, 4-dimethylaminobutyl, 6-dimethylaminohexyl, 2-hydroxy-2,2-dimethylethyl, 2-phenoxyethyl, 2-phenoxypropyl, 3-phenoxypropyl, 4-phenoxybutyl, 6-phenoxyhexyl, 2-methoxyethyl, 2-methoxypropyl, 3-methoxypropyl, 4-methoxybutyl, 6-methoxyhexyl, 2-ethoxyethyl, 2-ethoxypropyl, 3-ethoxypropyl, 4-ethoxybutyl or 6-ethoxyhexyl, and $C_2$-$C_{20}$-alkyl interrupted by one or more oxygen and/or sulphur atoms and/or one or more substituted or unsubstituted imino groups is, for example, 5-hydroxy-3-oxa-pentyl, 8-hydroxy-3,6-dioxaoctyl, 11-hydroxy-3,6,9-trioxaundecyl, 7-hydroxy-4-oxaheptyl, 11-hydroxy-4,8-dioxaundecyl, 15-hydroxy-4,8,12-trioxapentadecyl, 9-hydroxy-5-oxanonyl, 14-hydroxy-5,10-oxatetradecyl, 5-methoxy-3-oxapentyl, 8-methoxy-3,6-dioxaoctyl, 11-methoxy-3,6,9-trioxaundecyl, 7-methoxy-4-oxaheptyl, 11-methoxy-4,8-dioxa-undecyl, 15-methoxy-4,8,12-trioxapentadecyl, 9-methoxy-5-oxanonyl, 14-methoxy-5,10-oxatetradecyl, 5-ethoxy-3-oxapentyl, 8-ethoxy-3,6-dioxaoctyl, 11-ethoxy-3,6,9-trioxaundecyl, 7-ethoxy-4-oxaheptyl, 11-ethoxy-4,8-dioxaundecyl, 15-ethoxy-4,8,12-trioxapentadecyl, 9-ethoxy-5-oxanonyl or 14-ethoxy-5,10-oxatetradecyl.

If two radicals form a ring, they can together be 1,3-propylene, 1,4-butylene, 1,5-pentylene, 2-oxa-1,3-propylene, 1-oxa-1,3-propylene, 2-oxa-1,3-propylene, 1-oxa-1,3-propenylene, 1-aza-1,3-propenylene, 1-$C_1$-$C_4$-alkyl-1-aza-1,3-propenylene, 1,4-buta-1,3-dienylene, 1-aza-1,4-buta-1,3-dienylene or 2-aza-1,4-buta-1,3-dienylene.

The number of oxygen and/or sulphur atoms and/or imino groups is not subject to any restrictions. In general, there will be no more than 5 in the radical, preferably no more than 4 and very particularly preferably no more than 3.

Furthermore, there is generally at least one carbon atom, preferably at least two carbon atoms, between any two heteroatoms.

Substituted and unsubstituted imino groups can be, for example, imino, methylimino, isopropylimino, n-butylimino or tert-butylimino.

Furthermore, functional groups can be carboxy, carboxamide, hydroxy, di($C_1$-$C_4$-alkyl)amino, $C_1$-$C_4$-al-kyloxycarbonyl, cyano or $C_1$-$C_4$-alkyloxy, $C_6$-$C_{12}$-aryl which may be substituted by functional groups, aryl, alkyl, aryloxy, alkyloxy, halogen, heteroatoms and/or heterocycles is, for example, phenyl, tolyl, xylyl, α-naphthyl, β-naphthyl, 4-diphenylyl, chlorophenyl, dichlorophenyl, trichlorophenyl, difluorophenyl, methylphenyl, dimethylphenyl, trimethylphenyl, ethylphenyl, diethylphenyl, isopropylphenyl, tert-butylphenyl, dodecylphenyl, methoxyphenyl, dimethoxyphenyl, ethoxyphenyl, hexyloxyphenyl, methylnaphthyl, isopropylnaphthyl, chloronaphthyl, ethoxynaphthyl, 2,6-dimethylphenyl, 2,4,6-trimethylphenyl, 2,6-dimethoxyphenyl, 2,6-dichlorophenyl, 4-bromophenyl, 2- or 4-nitrophenyl, 2,4- or 2,6-dinitrophenyl, 4-di methylaminophenyl, 4-acetylphenyl, methoxyethylphenyl or ethoxymethylphenyl, $C_5$-$C_{12}$-cycloalkyl which may be substituted by functional groups, aryl, alkyl, aryloxy, alkyloxy, halogen, heteroatoms and/or heterocycles is, for example, cyclopentyl, cyclohexyl, cyclooctyl, cyclododecyl, methylcyclopentyl, dimethylcyclopentyl, methylcyclohexyl, dimethylcyclohexyl, di-ethylcyclohexyl, butylcyclohexyl, methoxycyclohexyl, dimethoxycyclohexyl, diethoxycyclohexyl, butylthiocyclohexyl, chlorocyclohexyl, dichlorocyclohexyl, dichlorocyclopentyl or a saturated or unsaturated bicyclic system such as norbornyl or norbornenyl, a five- or six-membered, oxygen-, nitrogen- and/or sulphur-containing heterocycle is, for example, furyl, thienyl, pyrryl, pyridyl, indolyl, benzoxazolyl, dioxolyl, dioxyl, benzimidazolyl, benzothiazolyl, dimethylpyridyl, methylquinolyl, dimethylpyrryl, methoxyfuryl, dimethoxypyridyl, difluoro-pyridyl, methylthienyl, isopropylthienyl or tert-butylthienyl and $C_1$ to $C_4$-alkyl is, for example, methyl, ethyl, propyl, isopropyl, n-butyl, sec-butyl or tert-butyl.

The residues $R^1$ to $R^5$ are preferably $C_2$-$C_{18}$-alkyl or $C_6$-$C_{12}$-aryl, more preferably $C_4$-$C_{16}$-alkyl or $C_6$-$C_{12}$-aryl, and even more preferably $C_4$-$C_{16}$-alkyl or $C_6$-aryl.

The residues $R^1$ to $R^5$ may be saturated or unsaturated, preferably saturated.

Preferred residues $R^1$ to $R^5$ do not bear any heteroatoms other than carbon of hydrogen.

Preferred examples of $R^1$ to $R^4$ are methyl, ethyl, propyl, isopropyl, n-butyl, sec-butyl, tert-butyl, pentyl, hexyl, heptyl, octyl, 2-ethylhexyl, 2,4,4-trimethylpentyl, 2-propylheptyl, decyl, dodecyl, tetradecyl, heptadecyl, octadecyl, eicosyl, 1,1-dimethylpropyl, 1,1-dimethylbutyl, 1,1,3,3-tetramethylbutyl, benzyl, 1-phenylethyl, 2-phenylethyl, α,α-dimethylbenzyl, benzhydryl, p-tol-ylmethyl or 1-(p-butylphenyl)ethyl.

In a preferred embodiment at least one of the residues $R^1$ to $R^4$ is selected from the group consisting of 2-hydroxyethyl, hydroxyprop-1-yl, hydroxyprop-2-yl, 2-hydroxybutyl or 2-hydroxy-2-phenylethyl.

In one embodiment $R^5$ is a polyolefin-homo- or copolymer, preferably a polypropylene, polybutene or polyisobutene residue, with a number-average molecular weight ($M_n$) of 85 to 20000, for example 113 to 10 000, or 200 to 10000 or 350 to 5000, for example 350 to 3000, 500 to 2500, 700 to 2500, or 800 to 1500. Preferred are polypropenyl, polybutenyl and polyisobutenyl radicals, for example with a number-average molecular weight $M_n$ of 3500 to 5000, 350 to 3000, 500 to 2500, 700 to 2500 and 800 to 1500 g/mol.

Preferred examples of anions $A^-$ are the anions of acetic acid, propionic acid, butyric acid, 2-ethylhexanoic acid, trimethylhexanoic acid, 2-propylheptanoic acid, isononanoic acid, versatic acids, decanoic acid, undecanoic acid, dodecanoic acid, saturated or unsaturated fatty acids with 12 to 24 carbon atoms, or mixtures thereof, salicylic acid, oxalic acid mono-$C_1$-$C_4$-alkyl ester, phthalic acid mono-$C_1$-$C_4$-alkyl ester, $C_{12}$-$C_{100}$-alkyl- and -alkenyl succinic acid, especially dodecenyl succinic acid, hexadecenyl succinic acid, eicosenyl succinic acid, and polyisobutenyl succinic acid. Further examples are methyl carbonate, ethyl carbonate, n-butyl carbonate, 2-hydroxyethyl carbonate, and 2-hydroxypropyl carbonate.

In one preferred embodiment the nitrogen compounds quaternized in the presence of an acid or in an acid-free manner are obtainable by addition of a compound which comprises at least one oxygen- or nitrogen-containing group reactive with an anhydride and additionally at least one quaternizable amino group onto a polycarboxylic anhydride compound and subsequent quaternization, especially with an epoxide, e.g. styrene or propylene oxide, in the absence of free acid, as described in WO 2012/004300, or with a carboxylic ester, e.g. dimethyl oxalate or methyl salicylate. Suitable compounds having at least one oxygen- or nitrogen-containing group reactive with anhydride and additionally at least one quaternizable amino group are especially polyamines having at least one primary or secondary amino group and at least one tertiary amino group, especially N,N-dimethyl-1,3-propane diamine, N,N-dimethyl-1,2-ethane diamine or N,N, N'-trimethyl-1,2-ethane diamine. Useful polycarboxylic anhydrides are especially dicarboxylic acids such as succinic acid, having a relatively long-chain hydrocarbyl substituent, preferably having a number-average molecular weight $M_n$ for the hydrocarbyl substituent of 200 to 10.000, in particular of 350 to 5000. Such a quaternized nitrogen compound is, for example, the reaction product, obtained at 40° C., of polyisobutenylsuccinic anhydride, in which the polyisobutenyl radical typically has an $M_n$ of 1000, with 3-(dimethylamino)propylamine, which constitutes a polyisobutenylsuccinic monoamide and which is subsequently quaternized with dimethyl oxalate or methyl salicylate or with styrene oxide or propylene oxide in the absence of free acid.

Further quaternized nitrogen compounds suitable as compounds (B) are described in WO 2006/135881 A1, page 5, line 13 to page 12, line 14;

WO 10/132259 A1, page 3, line 28 to page 10, line 25;

WO 2008/060888 A2, page 6, line 15 to page 14, line 29;

WO 2011/095819 A1, page 4, line 5 to page 9, line 29;

GB 2496514 A, paragraph [00012] to paragraph [00041];

WO 2013/117616 A1, page 3, line 34 to page 11, line 2;

WO 14/202425 A2, page 3, line 14 to page 5, line 9;

WO 14/195464 A1, page 15, line 31 to page 45, line 26 and page 75, lines 1 to 4;

WO 15/040147 A1, page 4, line 34 to page 5, line 18 and page 19, line 11 to page 50, line 10;

WO 14/064151 A1, page 5, line 14 to page 6, line 17 and page 16, line 10 to page 18, line 12;

WO 2013/064689 A1, page 18, line 16 to page 29, line 8; and

WO 2013/087701 A1, page 13, line 25 to page 19, line 30,

WO 13/000997 A1, page 17, line 4 to page 25, line 3,

WO 12/004300, page 5, lines 20 to 30, page 8, line 1 to page 10, line 10, and page 19, line 29 to page 28, line 3, each of which is incorporated herein by reference.

In one embodiment the quaternized ammonium compound (B) is of formula

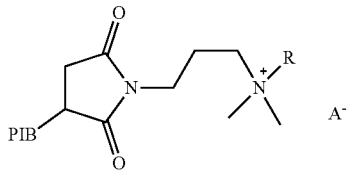

wherein in this formula

PIB stands for a polyisobutenyl residue having a number average molecular weight $M_n$ of from 550 to 2300, preferably from 650 to 1500 and more preferably from 750 to 1300 g/mol, R stands for an $C_1$- to $C_4$-alkyl or hydroxy-$C_1$- to $C_4$-alkyl, preferably methyl or 2-hydroxypropyl, and $A^-$ stands for an anion, preferably carboxylate $R^5COO^-$ or a carbonate $R^5O—COO^-$ as defined above, more preferably acetate, salicylate or methyloxalate.

In another preferred embodiment the quaternized ammonium compound (B) is of formula

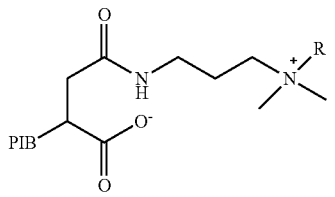

wherein in this formula

PIB stands for a polyisobutenyl residue having a number average molecular weight $M_n$ of from 550 to 2300, preferably from 650 to 1500 and more preferably from 750 to 1300 g/mol, R stands for a hydroxy-$C_1$- to $C_4$-alkyl, preferably 2-hydroxypropyl.

In another embodiment the quaternized compound (B) is of formula

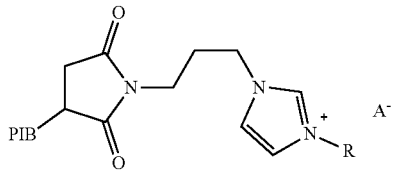

wherein in this formula

PIB stands for a polyisobutenyl residue having a number average molecular weight $M_n$ of from 550 to 2300, preferably from 650 to 1500 and more preferably from 750 to 1300 g/mol, R stands for an $C_1$- to $C_4$-alkyl or hydroxy-$C_1$- to $C_4$-alkyl, preferably methyl, and $A^-$ stands for an anion, preferably carboxylate $R^5COO^-$ or a carbonate $R^5O—COO^-$ as defined above, more preferably salicylate or methyloxalate.

In another embodiment the quaternized ammonium compound (B) is of formula

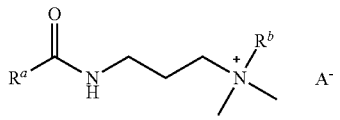

wherein in this formula $R^a$ stands for $C_1$-$C_{20}$-alkyl, preferably $C_9$- to $C_{17}$-alkyl, more preferably for undecyl, tridecyl, pentadecyl or heptadecyl, $R^b$ stands for a hydroxy-$C_1$- to $C_4$-alkyl, preferably 2-hydroxypropyl or 2-hydroxybutyl, and $A^-$ stands for an anion, preferably carboxylate $R^5COO^-$, as defined above, more preferably $R^5COO^-$ being a carboxylate of a fatty acid, especially $A^-$ being acetate, 2-ethylhexanoate, oleate or polyisobutenyl succinate.

In one embodiment the quaternized ammonium compound (B) is of formula

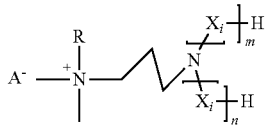

wherein in this formula $X_i$ for i=1 to n and 1 to m are independently of another selected from the group consisting of —$CH_2$—$CH_2$—O—, —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O— and —$CH(CH_3)$—$CH(CH_3)$—O—, preferably selected from the group consisting of —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O— and —$CH(CH_3)$—$CH(CH_3)$—O—, more preferably selected from the group consisting of —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O— and —$CH(C_2H_5)$—$CH_2$—O—, most preferably selected from the group consisting of —$CH_2$—$CH(C_2H_5)$—O—, —$CH(C_2H_5)$—$CH_2$—O—, —$CH_2$—$CH(CH_3)$—O— and —$CH(CH_3)$—$CH_2$—O—, and especially selected from the group consisting of —$CH_2$—$CH(CH_3)$—O— and —$CH(CH_3)$—$CH_2$—O—, m and n independently of another are positive integers, with the proviso that the sum (m+n) is from 2 to 50, preferably from 5 to 40, more preferably from 10 to 30, and especially from 15 to 25, R stands for an $C_1$- to $C_4$-alkyl, preferably methyl, and $A^-$ stands for an anion, preferably carboxylate $R^5COO^-$ or a carbonate $R^5O—COO^-$ as defined above, more preferably salicylate or methyloxalate.

In another preferred embodiment the quaternized ammonium compound (B) is of formula

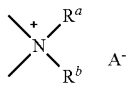

wherein in this formula $R^a$ and $R^b$ independently of another stand for $C_1$-$C_{20}$-alkyl or hydroxy-$C_1$- to $C_4$-alkyl, preferably $R^a$ stands for $C_1$-$C_{20}$-alkyl, preferably ethyl, n-butyl, n-octyl, n-dodecyl, tetradecyl or hexadecyl, and $R^b$ stands for hydroxy-$C_1$- to $C_4$-alkyl, preferably 2-hydroxypropyl, $A^-$ stands for an anion, preferably carboxylate $R^5COO^-$ or a carbonate $R^5O—COO^-$ as defined above, more preferably $C_{12}$-$C_{100}$-alkyl- and -alkenyl succinic acid, especially dodecenyl succinic acid, hexadecenyl succinic acid, eicosenyl succinic acid, and polyisobutenyl succinic acid.

Polyisobutenylsuccinimides (G) are of formula

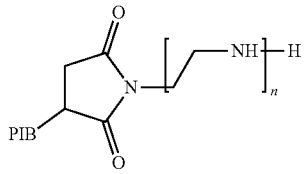

wherein in this formula

PIB stands for a polyisobutenyl residue having a number average molecular weight $M_n$ of from 550 to 2300, preferably from 650 to 1500 and more preferably from 750 to 1300 g/mol, and n stands for a positive integer of from 2 to 6, preferably 2 to 5, and more preferably 3 or 4.

Among the additives with detergent action quaternary nitrogen compounds (B) are preferred over the polyisobutenylsuccinimides (G).

Often the fuel oils and gasoline fuels are applied together with at least one dehazer exhibiting emulsifying action as additive component (C) selected from (C1) alkoxylation copolymers of ethylene oxide, propylene oxide, butylene oxide, styrene oxide and/or other oxides, e.g. epoxy based resins;

(C2) alkoxylated phenol formaldehyde resins.

Dehazer components (C1) and (C2) are normally commercially available products, e.g. the dehazer products available from Baker Petrolite under the brand name of Tolad® such as Tolad® 2898, 9360K, 9348, 9352K, 9327 or 286K.

In a further preferred embodiment of the present invention, the fuel oils additionally comprise as additive component (D) at least one cetane number improver. Cetane number improvers used are typically organic nitrates. Such organic nitrates are especially nitrate esters of unsubstituted or substituted aliphatic or cycloaliphatic alcohols, usually having up to about 10, in particular having 2 to 10 carbon atoms. The alkyl group in these nitrate esters may be linear or branched, and saturated or unsaturated. Typical examples of such nitrate esters are methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, sec-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate and isopropylcyclohexyl nitrate and also branched decyl nitrates of the formula $R^aR^bCH—CH_2—O—NO_2$ in which $R^a$ is an n-propyl or isopropyl radical and $R^b$ is a linear or branched alkyl radical having 5 carbon atoms, as described in WO 2008/092809. Additionally suitable are, for example, nitrate esters of alkoxy-substituted aliphatic alcohols such as 2-ethoxyethyl nitrate, 2-(2-ethoxy-ethoxy)ethyl nitrate, 1-methoxypropyl nitrate or 4-ethoxybutyl nitrate. Additionally suitable are also diol nitrates such as 1,6-hexamethylene dinitrate. Among the cetane number improver classes mentioned, preference is given to primary amyl nitrates, primary hexyl nitrates, octyl nitrates and mixtures thereof. Most preferably, 2-ethylhexyl nitrate is present in the fuel oils as the sole cetane number improver or in a mixture with other cetane number improvers.

In the context of the present invention, fuel oils mean preferably middle distillate fuels, especially diesel fuels. However, heating oils, jet fuels and kerosene shall also be encompassed. Diesel fuels or middle distillate fuels are typically mineral oil raffinates which generally have a boiling range from 100 to 400° C. These are usually distillates having a 95% point up to 360° C. or even higher. However, these may also be what is called "ultra low sulfur diesel" or "city diesel", characterized by a 95% point of, for example, not more than 345° C. and a sulfur content of not more than 0.005% by weight, or by a 95% point of, for example, 285° C. and a sulfur content of not more than 0.001% by weight. In addition to the diesel fuels obtainable by refining, the main constituents of which are relatively long-chain paraffins, those obtainable in a synthetic way by coal gasification or gas liquefaction ["gas to liquid" (GTL) fuels] are suitable, too. Also suitable are mixtures of the aforementioned diesel fuels with renewable fuels (biofuel oils) such as biodiesel or bioethanol. Of particular interest at present are diesel fuels with low sulfur content, i.e. with a sulfur content of less than 0.05% by weight, preferably of less than 0.02% by weight, particularly of less than 0.005% by weight and especially of less than 0.001% by weight of sulfur.

In a preferred embodiment, the olefin-carboxylic acid copolymer (A) is used together with the aforementioned components (B) respectively (G), if desired (C) and, if desired (D), in fuel oils which consist (a) to an extent of 0.1 to 100% by weight, preferably to an extent of 0.1 to less than 100% by weight, especially to an extent of 10 to 95% by weight and in particular to an extent of 30 to 90% by weight, of at least one biofuel oil based on fatty acid esters, and (b) to an extent of 0 to 99.9% by weight, preferably to an extent of more than 0 to 99.9% by weight, especially to an extent of 5 to 90% by weight, and in particular to an extent of 10 to 70% by weight, of middle distillates of fossil origin and/or of synthetic origin and/or of vegetable and/or animal origin, which are essentially hydrocarbon mixtures and are free of fatty acid esters.

The olefin-carboxylic acid copolymer (A) can also be used together with the aforementioned components (B) respectively (G), if desired (C) and, if desired (D), in fuel oils which consist exclusively of middle distillates of fossil origin and/or of synthetic origin and/or of vegetable and/or animal origin, which are essentially hydrocarbon mixtures and are free of fatty acid esters.

Fuel oil component (a) is usually also referred to as "biodiesel". This preferably comprises essentially alkyl esters of fatty acids which derive from vegetable and/or animal oils and/or fats. Alkyl esters typically refer to lower alkyl esters, especially $C_1$- to $C_4$-alkyl esters, which are obtainable by transesterifying the glycerides which occur in vegetable and/or animal oils and/or fats, especially triglycerides, by means of lower alcohols, for example, ethanol, n-propanol, iso-propanol, n-butanol, isobutanol, sec-butanol, tert-butanol or especially methanol ("FAME").

Examples of vegetable oils which can be converted to corresponding alkyl esters and can thus serve as the basis of biodiesel are castor oil, olive oil, peanut oil, palm kernel oil, coconut oil, mustard oil, cottonseed oil, and especially sunflower oil, palm oil, soybean oil and rapeseed oil. Further examples include oils which can be obtained from wheat, jute, sesame and shea tree nut; it is additionally also possible to use *arachis* oil, jatropha oil and linseed oil. The extraction of these oils and the conversion thereof to the alkyl esters are known from the prior art or can be inferred therefrom.

It is also possible to convert already used vegetable oils, for example used deep fat fryer oil, optionally after appropriate cleaning, to alkyl esters, and thus for them to serve as the basis of biodiesel.

Vegetable fats can in principle likewise be used as a source for biodiesel, but play a minor role.

Examples of animal oils and fats which can be converted to corresponding alkyl esters and can thus serve as the basis of biodiesel are fish oil, bovine tallow, porcine tallow and similar fats and oils obtained as wastes in the slaughter or utilization of farm animals or wild animals.

The parent saturated or unsaturated fatty acids of said vegetable and/or animal oils and/or fats, which usually have 12 to 22 carbon atoms and may bear an additional functional group such as hydroxyl groups, and which occur in the alkyl esters, are especially lauric acid, myristic acid, palmitic acid, stearic acid, oleic acid, linoleic acid, linolenic acid, elaidic acid, erucic acid and/or ricinoleic acid.

Typical lower alkyl esters based on vegetable and/or animal oils and/or fats, which find use as biodiesel or biodiesel components, are, for example, sunflower methyl ester, palm oil methyl ester ("PME"), soybean oil methyl ester ("SME") and especially rapeseed oil methyl ester ("RME").

However, it is also possible to use the monoglycerides, diglycerides and especially triglycerides themselves, for example castor oil, or mixtures of such glycerides, as biodiesel or components for biodiesel.

In the context of the present invention, the fuel oil component (b) shall be understood to mean the abovementioned middle distillate fuels, especially diesel fuels, especially those which boil in the range from 120 to 450° C.

In a further preferred embodiment, the olefin-carboxylic acid copolymer (A) is used together with the aforementioned components (B) respectively (G), (C) and, if desired (D), in fuel oils which have at least one of the following properties:

(α) a sulfur content of less than 50 mg/kg (corresponding to 0.005% by weight), especially less than 10 mg/kg (corresponding to 0.001% by weight);

(β) a maximum content of 8% by weight of polycyclic aromatic hydrocarbons;

(γ) a 95% distillation point (vol/vol) at not more than 360° C.

Polycyclic aromatic hydrocarbons in (β) shall be understood to mean polyaromatic hydrocarbons according to standard EN 12916. They are determined according to this standard.

The fuel oils comprise said olefin-carboxylic acid copolymer (A) in the context of the present invention generally in an amount of from 1 to 1000 ppm by weight, preferably of from 2 to 500 ppm by weight, more preferably of from 3 to 300 ppm by weight, most preferably of from 5 to 200 ppm by weight, for example of from 10 to 100 ppm by weight.

The additive with detergent action (B) respectively (G) or a mixture of a plurality of such additives with detergent action is present in the fuel oils typically in an amount of from 1 to 500 ppm by weight, preferably of from 2 to 250 ppm by weight, more preferably of from 3 to 100 ppm by weight, most preferably of from 4 to 75 ppm by weight, for example of from 5 to 50 ppm by weight.

One or more dehazers as additive component (C), if any, are present in the fuel oils generally in an amount of from 0.5 to 100 ppm by weight, preferably of from 1 to 50 ppm by weight, more preferably of from 1.5 to 40 ppm by weight, most preferably of from 2 to 30 ppm by weight, for example of from 3 to 20 ppm by weight.

The cetane number improver (D) or a mixture of a plurality of cetane number improvers is present in the fuel oils normally in an amount of form 10 to 10.000 ppm by weight, preferably of from 20 to 5000 ppm by weight, more preferably of from 50 to 2500 ppm by weight, most preferably of from 100 to 1000 ppm by weight, for example of from 150 to 750 ppm by weight.

Subject matter of the present invention is also a fuel additive concentrate suitable for use in fuel oils, especially in diesel fuel, comprising (A) 0.01 to 40% by weight, preferably 0.05 to 20% by weight, more preferably 0.1 to 10% by weight, of olefin-carboxylic acid copolymer comprising at least one hydrocarbyl substituent of from 10 to 3000 carbon atoms;

(B)/(G) 5 to 40% by weight, preferably 10 to 35% by weight, more preferably 15 to 30% by weight, of at least one compound (B) or (G);

(C) 0 to 5% by weight, preferably 0.01 to 5 by weight, more preferably 0.02 to 3.5% by weight, most preferably 0.05 to 2% by weight, of at least one dehazer selected from (C1) alkoxylation copolymers of ethylene oxide, propylene oxide, butylene oxide, styrene oxide and/or other oxides, e.g. epoxy based resins (C2) alkoxylated phenol formaldehyde resins;

(D) 0 to 75% by weight, preferably 5 to 75% by weight, more preferably 10 to 70% by weight, of at least one cetane number improver;

(E) 0 to 50% by weight, preferably 5 to 50% by weight, more preferably 10 to 40% by weight, of at least one solvent or diluent.

In each case, the sum of components (A), (B), (C), (D) and (E) results in 100%.

Said fuel oils such as diesel fuels, or said mixtures of biofuel oils and middle distillates of fossil, synthetic, vegetable or animal origin, may comprise, in addition to the olefin-carboxylic acid copolymer (A) and components (B) and, if any (C) and/or (D), as coadditives further customary additive components in amounts customary therefor, especially cold flow improvers, corrosion inhibitors, further demulsifiers, antifoams, antioxidants and thermal stabilizers, metal deactivators, antistats, lubricity improvers, dyes (markers) and/or diluents and solvents. Said fuel additive concentrates may also comprise certain of the above coadditives in amounts customary therefor, e.g. corrosion inhibitor, further demulsifiers, antifoams, antioxidants and thermal stabilizers, metal deactivators, antistats and lubricity improvers.

Cold flow improvers suitable as further coadditives are, for example, copolymers of ethylene with at least one further unsaturated monomer, in particular ethylene-vinyl acetate copolymers.

Corrosion inhibitors suitable as further coadditives are, for example, succinic esters, in particular with polyols, fatty acid derivatives, for example oleic esters, oligomerized fatty acids and substituted ethanolamines.

Further demulsifiers suitable as further coadditives are, for example, the alkali metal and alkaline earth metal salts of alkyl-substituted phenol- and naphthalenesulfonates and the alkali metal and alkaline earth metal salts of fatty acids, and also alcohol alkoxylates, e.g. alcohol ethoxylates, phenol alkoxylates, e.g. tert-butylphenol ethoxylates or tert-pentylphenol ethoxylates, fatty acids themselves, alkylphenols, condensation products of ethylene oxide and propylene oxide, e.g. ethylene oxide-propylene oxide block copolymers, polyethyleneimines and polysiloxanes.

Antifoams suitable as further coadditives are, for example, polyether-modified poly-siloxanes.

Antioxidants suitable as further coadditives are, for example, substituted phenols, e.g. 2,6-di-tert-butylphenol and 2,6-di-tert-butyl-3-methylphenol, and also phenylenediamines, e.g. N,N'-di-sec-butyl-p-phenylenediamine.

Metal deactivators suitable as further coadditives are, for example, salicylic acid derivatives, e.g. N,N'-disalicylidene-1,2-propanediamine.

A lubricity improver suitable as a further coadditive is, for example, glyceryl mono-oleate.

Suitable solvents and diluents as component (E), especially for diesel performance packages, are, for example, nonpolar organic solvents, especially aromatic and aliphatic hydrocarbons, for example toluene, xylenes, "white spirit" and the technical solvent mixtures of the designations Shellsol® (manufactured by Royal Dutch/Shell Group), Exxol® (manufactured by ExxonMobil) and Solvent Naphtha. Also useful here, especially in a blend with the nonpolar organic solvents mentioned, are polar organic solvents, in particular alcohols such as 2-ethylhexanol, decanol and isotridecanol.

In a further preferred embodiment of the present invention, the gasoline fuels additionally may comprise as additive component (F) at least one carrier oil which is substantially free of nitrogen, selected from synthetic carrier oils and mineral oils. The carrier oil of component (F) may be a synthetic oil or a mineral oil; for the instant invention, a refined petroleum oil is also understood to be a mineral oil.

The carrier oil of component (F) is typically employed in amounts ranging from about 50 to about 2,000 ppm by weight of the gasoline fuel, preferably from 100 to 800 ppm of the gasoline fuel. Preferably, the ratio of carrier oil (F) to additive component (B) respectively (G) will range from 0.35:1 to 10:1, typically from 0.4:1 to 2:1.

Examples for suitable mineral carrier oils are in particular those of viscosity class Solvent Neutral (SN) 500 to 2000, as well as aromatic and paraffinic hydrocarbons and alkoxyalkanols. Another useful mineral carrier oil is a fraction known as "hydrocrack oil" which is obtained from refined mineral oil (boiling point of approximately 360 to 500° C.; obtainable from natural mineral oil which is isomerized, freed of paraffin components and catalytically hydrogenated under high pressure).

Examples for synthetic carrier oils which can be used for the instant invention are olefin polymers with a number average molecular weight of from 400 to 1,800 g/mol, based on poly-alpha-olefins or poly-internal-olefins, especially those based on polybutene or on polyisobutene (hydrogenated or non-hydrogenated). Further examples for suitable synthetic carrier oils are poly-esters, polyalkoxylates, polyethers, alkylphenol-initiated polyethers, and carboxylic acids of long-chain alkanols.

Examples for suitable polyethers which can be used for the instant invention are compounds containing polyoxy-$C_2$-$C_4$-alkylene groups, especially polyoxy-$C_3$-$C_4$-alkylene groups, which can be obtained by reacting $C_1$-$C_{30}$-alkanols, $C_2$-$C_{60}$-alkandiols, $C_1$-$C_{30}$-alkylcyclohexanols or $C_1$-$C_{30}$-alkylphenols with 1 to 30 mol ethylene oxide and/or propylene oxide and/or butylene oxides per hydroxyl group, especially with 1 to 30 mol propylene oxide and/or butylene oxides per hydroxyl group. This type of compounds is described, for example, in EP-A 310 875, EP-A 356 725, EP-A 700 985 and U.S. Pat. No. 4,877,416.

Typical examples for suitable polyethers are tridecanol propoxylates, tridecanol butoxylates, isotridecanol butoxylates, 2-propylheptanol propoxylates, 2-propylheptanol butoxylates, heptadecanol propoxylates, isoheptadecanol propoxylates, heptadecanol butoxylates, isoheptadecanol butoxylates, isononylphenol butoxylates, polyisobutenol butoxylates and polyisobutenol propoxylates. In a preferred embodiment, carrier oil component (F) comprises at least one polyether obtained from $C_1$- to $C_{30}$-alkanols, especially $C_6$- to $C_{18}$-alkanols, or $C_2$- to $C_{60}$-alkandiols, especially $C_8$- to $C_{24}$-alkandiols, and from 1 to 30 mol, especially 5 to 30 mol, in sum, of propylene oxide and/or butylene oxides. Other synthetic carrier oils and/or mineral carrier oils may be present in component (F) in minor amounts.

In the context of the present invention, gasoline fuels mean liquid hydrocarbon distillate fuels boiling in the gasoline range. It is in principle suitable for use in all types of gasoline, including "light" and "severe" gasoline species. The gasoline fuels may also contain amounts of other fuels such as, for example, ethanol.

Typically, gasoline fuels, which may be used according to the present invention exhibit, in addition, one or more of the following features:

The aromatics content of the gasoline fuel is preferably not more than 50 volume % and more preferably not more than 35 volume %. Preferred ranges for the aromatics content are from 1 to volume % and particularly from 5 to 35 volume %.

The sulfur content of the gasoline fuel is preferably not more than 100 ppm by weight and more preferably not more than 10 ppm by weight. Preferred ranges for the sulfur content are from 0.5 to 150 ppm by weight and particularly from 1 to 10 ppm by weight.

The gasoline fuel has an olefin content of not more than 21 volume %, preferably not more than 18 volume %, and more preferably not more than 10 volume %. Preferred ranges for the olefin content are from 0.1 to 21 volume % and particularly from 2 to 18 volume %.

The gasoline fuel has a benzene content of not more than 1.0 volume % and preferably not more than 0.9 volume %. Preferred ranges for the benzene content are from 0 to 1.0 volume % and preferably from 0.05 to 0.9 volume %.

The gasoline fuel has an oxygen content of not more than 45 weight %, preferably from 0 to weight %, and most preferably from 0.1 to 3.7 weight % (first type) or most preferably from 3.7 to 45 weight % (second type). The gasoline fuel of the second type mentioned above is a mixture of lower alcohols such as methanol or especially ethanol, which derive preferably from natural source like plants, with mineral oil based gasoline, i.e. usual gasoline produced from crude oil. An example for such gasoline is "E 85", a mixture of 85 volume % of ethanol with 15 volume % of mineral oil based gasoline. Also a fuel containing 100% of a lower alcohol, especially ethanol, is suitable.

The content of alcohols, especially lower alcohols, and ethers in a gasoline fuel of the first type mentioned in the above paragraph is normally relatively low. Typical maximum contents are for methanol 3 volume %, for ethanol 5 volume %, for isopropanol 10 volume %, for tert-butanol 7 volume %, for iso-butanol 10 volume %, and for ethers containing 5 or more carbon atoms in the molecule 15 volume %.

For example, a gasoline fuel which has an aromatics content of not more than 38 volume % and at the same time an olefin content of not more than 21 volume %, a sulfur content of not more than 50 ppm by weight, a benzene content of not more than 1.0 volume % and an oxygen content of from 0.1 to 2.7 weight % may be applied.

The summer vapor pressure of the gasoline fuel is usually not more than 70 kPa and preferably not more than 60 kPa (at 37° C.).

The research octane number ("RON") of the gasoline fuel is usually from 90 to 100. A usual range for the corresponding motor octane number ("MON") is from 80 to 90.

The above characteristics are determined by conventional methods (DIN EN 228).

The gasoline fuels comprise said olefin-carboxylic acid copolymer (A) in the context of the present invention generally in an amount of from 1 to 1000 ppm by weight, preferably of from 5 to 500 ppm by weight, more preferably of from 3 to 300 ppm by weight, most preferably of from 5 to 200 ppm by weight, for example of from 10 to 100 ppm by weight.

The additive with detergent action (B) or a mixture of a plurality of such additives with detergent action is present in the gasoline fuels typically in an amount of from 1 to 500 ppm by weight, preferably of from 2 to 250 ppm by weight, more preferably of from 3 to 100 ppm by weight, most preferably of from 4 to 50 ppm by weight, for example of from 5 to 30 ppm by weight.

In case of an additive with detergent action (G) or a mixture of a plurality of such additives with detergent action, the additive is typically present in the gasoline fuels in an amount of from 1 to 500 ppm by weight, preferably of from 1 to 300 ppm by weight, more preferably of from 1 to 250 ppm by weight, and most preferably of from 2 to 150 ppm by weight.

One or more dehazers as additive component (C), if any, are present in the gasoline fuels generally in an amount of from 0.5 to 100 ppm by weight, preferably of from 1 to 50 ppm by weight, more preferably of from 1.5 to 40 ppm by weight, most preferably of from 2 to 30 ppm by weight, for example of from 3 to 20 ppm by weight.

The one or more carrier oils (F), if any, are present in the gasoline fuels normally in an amount of form 10 to 3.000 ppm by weight, preferably of from 20 to 1000 ppm by weight, more preferably of from 50 to 700 ppm by weight, most preferably of from 70 to 500 ppm by weight, for example of from 150 to 300 ppm by weight.

Subject matter of the present invention is also a fuel additive concentrate suitable for use in gasoline fuels comprising (A) 0.01 to 40% by weight, preferably 0.05 to 20% by weight, more preferably 0.1 to 10% by weight, of a olefin-carboxylic acid copolymer comprising at least one hydrocarbyl substituent of from 10 to 3000 carbon atoms;

(B)/(G) 5 to 40% by weight, preferably 10 to 35% by weight, more preferably 15 to 30% by weight, of at least one compound (B) respectively (G);

(C) 0 to 5% by weight, preferably 0.01 to 5 by weight, more preferably 0.02 to 3.5% by weight, most preferably 0.05 to 2% by weight, of at least one dehazer selected from (C1) alkoxylation copolymers of ethylene oxide, propylene oxide, butylene oxide, styrene oxide and/or other oxides, e.g. epoxy based resins (C2) alkoxylated phenol formaldehyde resins;

(E) 0 to 80% by weight, preferably 5 to 50% by weight, more preferably 10 to 40% by weight, of at least one solvent or diluent;

(F) 2 to 50% by weight, preferably 10 to 50% by weight, more preferably 25 to 45% by weight, of at least one carrier oil which is substantially free of nitrogen, selected from synthetic carrier oils and mineral carrier oils.

In each case, the sum of components (A), (B) respectively (G), (C), (D), (E) and (F) results in 100%.

The amounts given throughout the text refer to the pure components excluding e.g. solvent, un-less stated otherwise.

Said gasoline fuels may comprise, in addition to the olefin-carboxylic acid copolymer (A) and components (B) respectively (G) and, if any (C) and/or (F), as coadditives further customary additive components in amounts customary therefor, especially corrosion inhibitors, further demulsifiers, antioxidants and thermal stabilizers, metal deactivators, antistats, friction modifyers, dyes (markers) and/or diluents and solvents such as component (E) as defined above. Said gasoline fuel additive concentrates may also comprise certain of the said coadditives in amounts customary therefor, e.g. corrosion inhibitor, further demulsifiers, antifoams, antioxidants and thermal stabilizers, metal deactivators, antistats and friction modifyers.

Another object of the present invention is a process for improving the stability of additives with detergent action in fuel additive packages by applying at least one olefin-carboxylic acid copolymer (A)

to a fuel additive package comprising at least one additive with detergent action selected from the group consisting of quaternary nitrogen compounds (B) and polyisobutenylsuccinimides (G).

The examples which follow are intended to illustrate the present invention without restricting it.

EXAMPLES

Additive Formulations (Given in Weight %) (Gasoline Additive Formulation)

| Example | 1 (Comparative) | 2 (Inventive) | 3 (Inventive) |
|---|---|---|---|
| Detergent [a)] | 26.65 | 26.60 | 26.56 |
| Carrier Oil [b)] | 14.73 | 14.71 | 14.69 |
| Quaternary Detergent [c)] | 9.40 | 9.39 | 9.38 |
| Oleic Acid [d)] | 10.97 | 10.96 | 10.94 |
| Solvesso 150 | 31.98 | 31.93 | 31.88 |
| 2-Ethylhexanol | 6.27 | 6.26 | 6.25 |
| Component (A) [e)] | — | 0.16 | 0.31 |

[a)] Detergent Polyisobutene amine, molecular weight approx. 1000 g/mol, commercially available as KEROCOM ® PIBA 03 from BASF

[b)] Carrier oil: $C_{13}$-alkanol propoxylate according to WO 00/02978, molecular weight Mn approx. 1300 g/mol

[c)] Quaternary Ammonium Salt Detergent: Reaction product of n-hexadecyldimethylamine with propylene oxide, with hydrolyzed polyisobutenyl succinic acid as counterion as described in EP 3004294 B1, Synthetic Example 6 (applied as 50 wt % solution in 2-ethylhexanol).

[d)] Oleic acid as friction modifier

[e)] Hydrolyzed copolymer of a mixture of $C_{20}$ to $C_{24}$ alpha-olefins with maleic acid anhydride, Mn: 1500 g/mol, Mw: 3200 g/mol, applied as 40% solution in Solvesso, as described in EP 3099720 B1, Synthetic Example 2.

Application Tests 100 ml of the formulations 1 to 3 were stored at −20° C. for a period of 3 days.

1) The samples were examined for their turbidity immediately after storage (FIG. 1, from left to right) with the result as follows:

Example 1 (most turbid)>Example 2 (less turbid)>Example 3 (least turbid)

Figure 2:
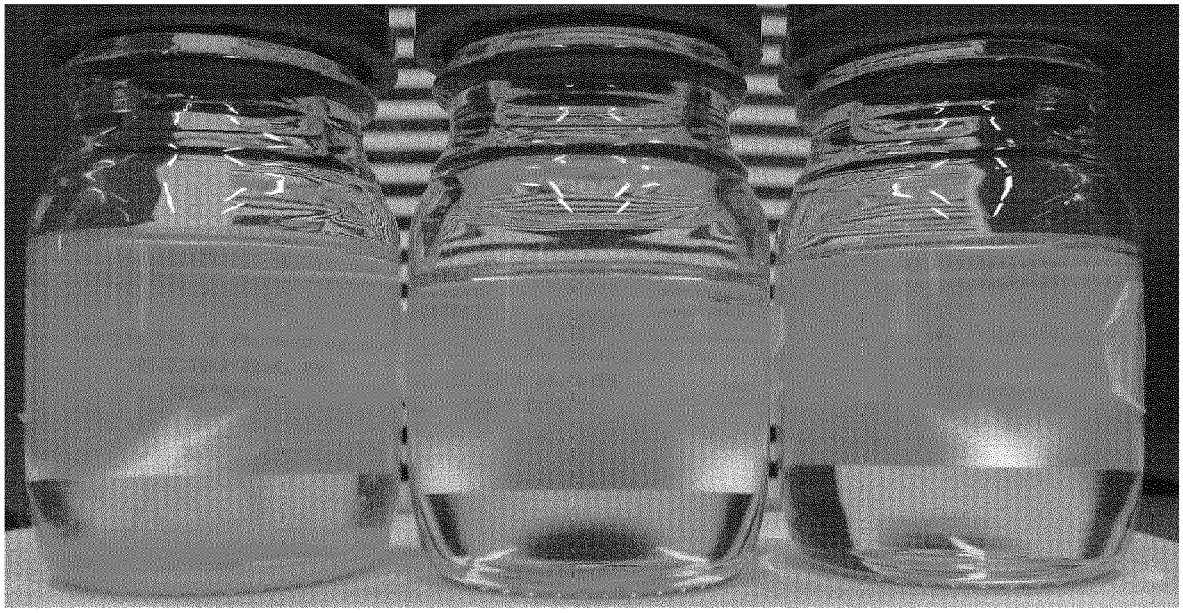

2) Afterwards the samples were allowed to warm up to room temperature and were examined for their turbidity (FIG. 2, from left to right) with the result as follows:

Example 1 (slightly turbid)>Example 2 (clear)>Example 3 (clear)

Since the formulation of Example 1 exhibits a turbidity even after storage at −20° C. for 3 days which remains after warming to room temperature it fails the stability criterion. In contrast, the formulations of Examples 2 and 3 remain stable at −20° C. for more than 8 weeks.

Additive Formulations (Given in Weight Amount) (Diesel Additive Formulation)

| Example | 4 (Comparative) | 5 (Inventive) |
|---|---|---|
| Quaternary Detergent (B) [a)] | 21.9 | 21.9 |
| Tall oil fatty acid | 8.8 | 8.8 |
| Antifoam (Si containing) | 1.8 | 1.8 |
| Dehazer | 1.8 | 1.8 |
| 2-Ethylhexyl nitrate | 65.7 | 64.8 |
| Component (A) [b)] | — | 0.9 |

[a)] Detergent Polyisobutene succinid acid converted with DMAPA and PO, molecular weight approx. 1200 g/mol, see WO 2012/004300 Ex 1, 50% polymer content in 50% solvent

[b)] Hydrolyzed copolymer of a mixture of $C_{20}$ to $C_{24}$ alpha-olefins with maleic acid anhydride, Mn: 1500 g/mol, Mw: 3200 g/mol, as described in EP 3099720 B1, Synthetic Example 2.

Application Tests 100 ml of the formulations 4 and 5 were stored at −30° C. for a period of 7 days. The samples were examined for their turbidity after this storage period:

Example 4 (turbid, sediments)

Example 5 (not turbid, no sediments)

Since the comparative formulation of Example 4 exhibits sediments and turbidity after storage at −30° C. for 7 days, it is clearly less stable than Example 5 according to the invention.

The invention claimed is:

1. A process for improving the stability of an additive with detergent action in a gasoline additive package, the process comprising:

applying at least one olefin-carboxylic acid copolymer (A) with a number-average molecular weight Mn of from 0.5 to 10 kDa (determined by gel permeation chromatography with tetrahydrofuran and polystyrene as standard), obtainable by in a first reaction (I), copolymerizing (Aa) at least one ethylenically unsaturated mono- or dicarboxylic acid or derivative thereof, (Ab) at least one α-olefin having from at least 12 up to and including 30 carbon atoms, (Ac) optionally, at least one further aliphatic or cycloaliphatic olefin which has at least 4 carbon atoms and is different than (Ab), and (Ad) optionally, one or more further copolymerizable monomers other than monomers (Aa), (Ab), and (Ac), selected from the group consisting of (Ada) vinyl esters, (Adb) vinyl ethers, (Adc) (meth)acrylic esters of alcohols having at least 5 carbon atoms, (Add) allyl alcohols or ethers thereof, (Ade)N-vinyl compounds selected from the group consisting of vinyl compounds of heterocycles containing at least one nitrogen atom, N-vinylamides, and N-vinyllactams, (Adf) ethylenically unsaturated aromatics, (Adg) α,β-ethylenically unsaturated nitriles, (Adh) (meth) acrylamides, and (Adi) allylamines, followed by in a second optional reaction (II) partly or fully hydrolyzing and/or saponifying anhydride or carboxylic ester functionalities present in a copolymer obtained from (I), the second reaction being run at least when the copolymer obtained from reaction (I) does not comprise any free carboxylic functionalities;

to a gasoline additive package comprising at least one quaternary nitrogen compound (B) as an additive with detergent action and at least one fatty acid, fatty acid ester, or oligomerized fatty acid, wherein the gasoline additive package has a content of 0.01 to 40 wt. % of said at least one olefin-carboxylic acid copolymer (A) and a content of 5 to 40% by weight of the at least one quaternary nitrogen compound (B), wherein the gasoline additive package with the at least one olefin-carboxylic acid copolymer (A) exhibits less demixing after storage at −20° C. for 3 days, compared to the gasoline additive package without the at least one olefin-carboxylic acid copolymer (A), and wherein the nitrogen compound (B) is of formula

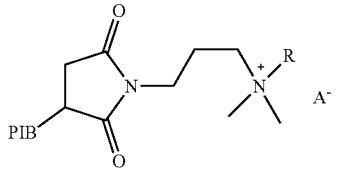

wherein in this formula

PIB is a polyisobutenyl residue having a number average molecular weight $M_n$ of from 750 to 1300 g/mol, R is methyl, and $A^-$ is salicylate or methyloxalate, wherein the gasoline additive package further comprises as additive component (F) at least one carrier oil which is substantially free of nitrogen, selected from polyesters, polyalkoxylates, polyethers, and alkylphenol-initiated polyethers, wherein the gasoline additive package does not comprise an organic nitrate, and wherein the process further comprises adding the gasoline additive package to gasoline which is not diesel fuel.

2. The process according to claim 1, wherein (Aa) is at least one ethylenically unsaturated dicarboxylic acid.

3. The process according to claim 1, wherein monomer (Aa) is maleic acid anhydride.

4. The process according to claim 1, wherein monomer (Ab) is one or more linear or branched 1-alkene.

5. The process according to claim 1, wherein no (Ac) and (Ad) are present in the copolymer.

6. The process according to claim 1, wherein the gasoline additive package with the at least one olefin-carboxylic acid copolymer (A) exhibits less demixing after storage at −30° C. for 7 days, compared to the gasoline additive package without the at least one olefin-carboxylic acid copolymer (A).

7. The process according to claim 1, wherein the at least one fatty acid, fatty acid ester, or oligomerized fatty acid is at least one selected from the group consisting of lauric acid, myristic acid, palmitic acid, stearic acid, oleic acid, linoleic acid, linolenic acid, elaidic acid, erucic acid, ricinoleic acid, oligomerized fatty acids, and tall oil fatty acid.

8. The process according to claim 1, wherein the at least one fatty acid, fatty acid ester, or oligomerized fatty acid is oleic acid.

9. The process according to claim 1, wherein the at least one fatty acid, fatty acid ester, or oligomerized fatty acid is tall oil fatty acid.

10. The process according to claim 1, wherein $A^-$ is salicylate.

11. The process according to claim 1, wherein the gasoline additive package further comprises as additive component (F) at least one carrier oil which is substantially free of nitrogen, selected from tridecanol propoxylates, tridecanol butoxylates, isotridecanol butoxylates, 2-propylheptanol propoxylates, 2-propylheptanol butoxylates, heptadecanol propoxylates, isoheptadecanol propoxylates, heptadecanol butoxylates, isoheptadecanol butoxylates, isononylphenol butoxylates, polyisobutenol butoxylates, and polyisobutenol propoxylates.

12. The process according to claim 1, wherein (A) is applied to the gasoline additive package comprising (B) with at least one dehazer as additive component (C) selected from the group consisting of (C1) alkoxylation copolymers of ethylene oxide, propylene oxide, butylene oxide, styrene oxide, and/or other oxides; and (C2) alkoxylated phenol formaldehyde resins.

13. The process according to claim 1, wherein the amount of component (A) is 0.1 to 10 wt %.

14. The process according to claim 1, wherein the amount of component (A) is 0.1 to 0.9 wt %.

15. The process according to claim 1, wherein the amount of component (B) is 10 to 35 wt %.

16. The process according to claim 1, wherein the amount of component (B) is 15 to 30 wt %.

* * * * *